United States Patent [19]

Bouteca

[11] Patent Number: 4,660,415

[45] Date of Patent: Apr. 28, 1987

[54] METHOD FOR DETERMINING AT LEAST ONE MAGNITUDE CHARACTERISTIC OF A GEOLOGICAL FORMATION

[75] Inventor: Maurice Bouteca, Paris, France

[73] Assignee: Institut Francais du Petrole, Cedex, France

[21] Appl. No.: 750,785

[22] Filed: Jul. 1, 1985

[30] Foreign Application Priority Data

Jun. 29, 1984 [FR] France ..... 84 10305

[51] Int. Cl.[4] ..... E21B 47/00; G01L 1/00

[52] U.S. Cl. ..... 73/155; 73/784; 166/250

[58] Field of Search ..... 166/250, 308; 73/784, 73/155

[56] References Cited

U.S. PATENT DOCUMENTS

| | | | |
|---|---|---|---|
| 4,372,380 | 2/1983 | Smith et al. | 166/250 |
| 4,389,896 | 6/1983 | Babcock | 73/784 |
| 4,398,416 | 8/1983 | Nolte | 73/155 |
| 4,434,848 | 3/1984 | Smith | 166/250 |
| 4,515,214 | 5/1985 | Fitch et al. | 166/250 |

OTHER PUBLICATIONS

Abou-Sayed, A. S., "An Experimental Tech. for Measuring the Fracture Toughness of Rocks Under Downhole Stress Condition" 6th Intern. Conference of Experimental Stress Analysis, Munich, Germany, Sep. 1978.

*Primary Examiner*—Stephen J. Novosad
*Assistant Examiner*—Bruce M. Kisliuk
*Attorney, Agent, or Firm*—Antonelli, Terry & Wands

[57] ABSTRACT

A method is provided for determining at least one characteristic magnitude of a geological formation from a so-called characteristic set formed of three magnitudes designated respectively by $K_{1C}$, $\sigma_3$ and $H_F$ which are the stress intensity factor of the formation, the minimum in situ principle stress and the fracture height knowing at least one of these magnitudes. In this method, the geological formation is subjected to a fracturing operation during which the minimum pressure reached during the fracturing and the volume $V_m$ of the fracture at the time when the pressure is minimum are determined. Then the desired characteristic is determined from mathematical relationships.

2 Claims, 1 Drawing Figure

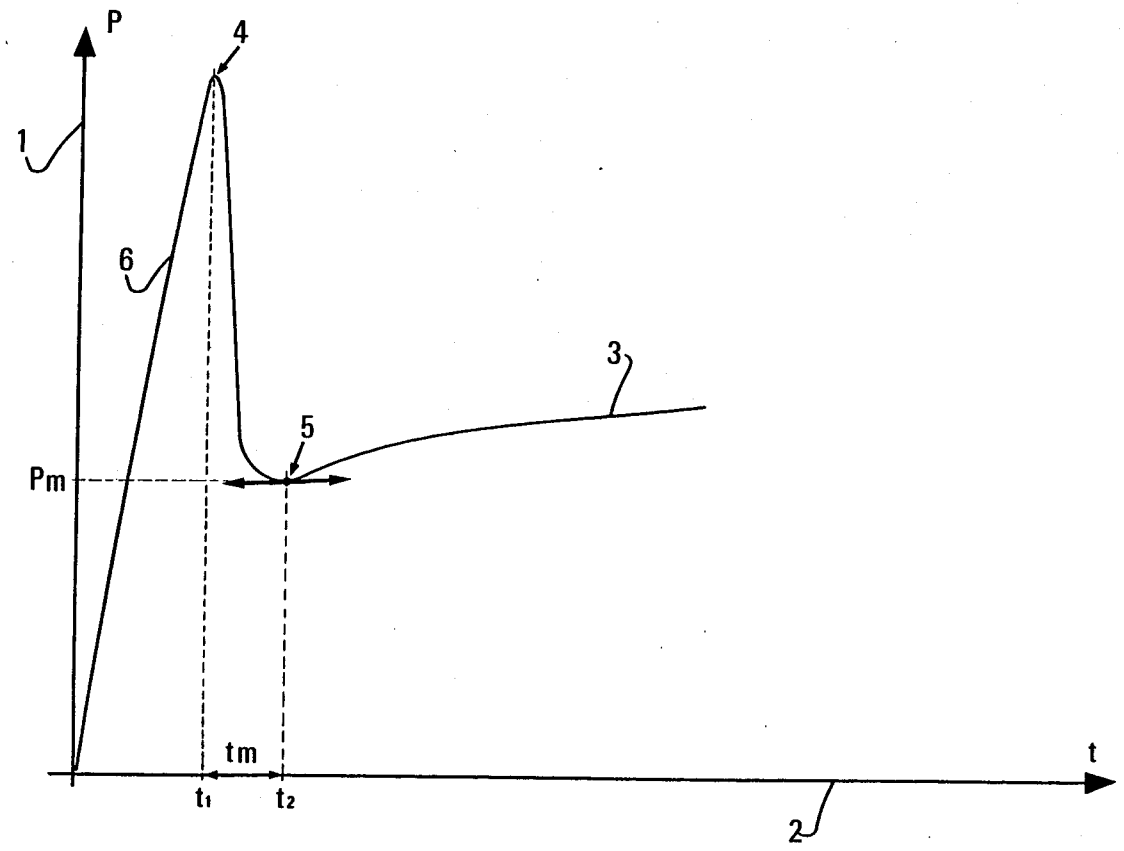
P
1
4
6
Pm
5
3
t
2
t1
tm
t2

METHOD FOR DETERMINING AT LEAST ONE MAGNITUDE CHARACTERISTIC OF A GEOLOGICAL FORMATION

BACKGROUND OF THE INVENTION

The present invention relates to a method for determining at least one magnitude characteristic of a geological formation chosen from a so-called characteristic set formed of three magnitudes designated respectively by $K_{1C}$, $\sigma_3$ and $H_F$ which are the stress intensity factor of the formation, the minimum in situ principle stress and the fracture height, knowing at least one of these magnitudes.

It is obvious that the last magnitude depends not only on the geological formation but also but also on the fracturing conditions.

To have a good knowledge of a geological formation, more especially for carrying out fracturing thereof, it is necessary to know the values of $K_{1C}$ and $\sigma_3$.

SUMMARY OF THE INVENTION

The method according to the invention makes it possible to know the value of the tenacity of a geological formation with a better accuracy than that provided by the methods of the prior art.

Determining $\sigma_3$ by the method of the present invention allows this magnitude to be accessed by a different way from that of the prior art and so allows the value of this magnitude to be verified by cross-checking.

Furthermore, the method of the invention may, during a fracturing operation allow the height of the fracture to be determined. Thus the fracturing operation can be controlled and fracturing of the adjacent layers avoided.

The prior art may be illustrated by the U.S. Pat. Nos. 4,393,933 and 4,372,380.

Thus, the present invention provides a method for determining at least one magnitude characteristic of a geological formation chosen from a so-called characteristic set formed of the following magnitudes: the stress intensity factor of the formation, minimum in situ principle stress and the fracture height, designated respectively by $K_{1C}$, $\sigma_3$ and $H_F$, the last magnitude further depending on the conditions of a fracturing operation, knowing at least one of these magnitudes.

According to the present method, the geological formation is subjected to fracturing and during this fracturing at least one of the two magnitudes is determined which are the minimum pressure $P_m$ reached substantially at the level of the fracturing and the volume $V_m$ of the fracturing from the moment when said fracturing begins up to the moment when said minimum pressure is reached and said desired characteristic magnitude is determined from one at least of the two following relationships:

$$\frac{H_F}{2} = \left( \frac{3V_m E}{8\sqrt{\pi}\,(1-\eta^2)K_{1C}} \right)^{\frac{2}{5}}$$

$$\sigma_3 = P_m - K_{1C}\left(\frac{\pi}{2H_F}\right)^{\frac{1}{2}}$$

in which $P_m$ is said minimum pressure, $V_m$ is said volume of the fracturing, E and $\eta$ being characteristics of the rock, respectively Young's modulus and Poisson's coefficient and $K_{1C}$, $\sigma_3$ and $H_F$ being the three magnitudes of said characteristic set.

In a variant of the method, fracturing of the geological formation is effected by injecting at a substantially constant voluminal flowrate $Q_m$ a substantially incompressible fracturation fluid and measuring the lapse of time $t_m$ separating the moment of beginning of the fracture from the moment when said minimum pressure $P_m$ is reached for determining the volume injected into the fracture. The volume injected into the fracture is then equal to the product of $t_m$ multiplied by the voluminal flowrate $Q_m$.

As is clear, it is necessary to cause a fracturing of the formation in order to implement the method of the invention.

If the method of the invention is used for determining one at least of the two characteristic magnitudes $K_{1C}$ or $\sigma_3$, the fracturing operation could be interrupted as soon as the minimum pressure $P_m$ is reached.

If the method of the invention is applied to checking the fracturing height $H_F$ with a view to carrying out a veritable fracturing operation of the formation, it will be preferable to effect a first fracturing by taking the necessary measurements, particularly that for determining the pressure at the level of the formation, by introducing one or more measuring probes into the formation then interrupting this first fracturing so as to remove the measuring probes. Then to carry out a second fracturing which may itself be followed by introducing sustaining agents into the formation without prejudice for the measuring probes.

It is obvious that a single fracturing operation could be carried out without departing from the scope of the present invention.

The possibility of making measurements during the veritable fracturing allows the evolution of a characteristic magnitude to be followed during the fracturing operation.

The present invention will be better understood and its advantages will be more clearly understood from the description of a particular example in no wise limitative.

BRIEF DESCRIPTION OF THE DRAWING

The FIGURE shows a curve of the pressure as a function of time in a constant flowrate fracturing process.

DESCRIPTION OF THE PREFERRED EMBODIMENT

In this example, it is desired to determine the characteristic magnitude $K_{1C}$ of a geological formation.

For this, a fracturing fluid is injected at a constant flowrate into the geological formation and the curve of the pressure prevailing in this formation is recorded as a function of time.

This curve is shown in the accompanying FIGURE.

The ordinate axis 1 represents the axis of the pressures and the abscissa axis 2 represents the axis of time.

Curve 3 shows the evolution of the pressure prevailing at the level of the formation as a function of time during the fracturing operation.

Generally, when injecting a fracturing fluid into a geological formation, it can be observed that the pressure increases. This corresponds to part 6 of the curve. The pressure reaches a maximum at 4 then decreases. In the FIGURE, the time when the pressure has reached its maximum is designated by $t_1$. It is from this moment $t_1$ that the fracture may be considered as being begun. The pressure continues to decrease to reach a minimum $P_m$ at the point designated by the reference 5, this point corresponding to time $t_2$. If injection of fluid were continued, it would be observed that the pressure again increases.

However, since in the present example it is only desired to determine $K_{1C}$, it is useless to continue the injection of fracturing fluid.

From the two following relationships, it is possible to determine $K_{1C}$.

$$\frac{H_F}{2} = \left( \frac{3V_m E}{8\sqrt{\pi}\,(1-\eta^2)K_{1C}} \right)^{\frac{2}{5}} \quad \text{Relationship 1}$$

$$\sigma_3 = P_m - K_{1C}\left(\frac{\pi}{2H_F}\right)^{\frac{1}{2}} \quad \text{Relationship 2}$$

in which:

$P_m$ designates the minimum pressure reached during the above-described fracturing operation, $V_m$ designates the volume of the fracturing and corresponds substantially to the volume of fluid introduced into the fracture, at least if this latter was incompressible, from the beginning thereof up to the time when the pressure has reached a minimum $P_m$.

$K_{1C}$, $\sigma_3$ and $H_F$ designate the three characteristic magnitudes of the formation.

E and $\eta$ designate Young's modulus and Poisson's coefficient of the formation. These two values may be determined in the laboratory from a sample of said formation.

Thus, the values of E, $\eta$ are known and the values of $P_m$ and $V_m$ are obtained from curve 3 since $V_m$ is equal to the product of the flow of fracturing fluid (since it is constant and since it is assumed that a substantially incompressible fracturing fluid is used) multiplied by the time $t_m = t_2 - t_1$.

It is then sufficient to know either $\sigma_3$ or $H_F$ for determining $K_{1C}$ and the value of the unknown magnitude respectively $H_F$ or $\sigma_3$.

It is possible to determine $\sigma_3$ by a method described for example in the communication SPE 8341 of "Shut-in pressure". $K_{1C}$ and possibly $H_F$ may then be determined by resolving the system of the two relationships or else, if the fracturing height $H_F$ is known sufficiently accurately, $K_{1C}$ may be determined solely from the measurement of the volume $V_m$ introduced into the fracture between the beginning of the fracture and the moment when the pressure in the formation reaches a minimum during injection of the fracturing fluid. Knowing the value of $P_m$, $\sigma_3$ may be determined.

What is claimed is:

1. A method for determining at least one magnitude characteristic of a geological formation in a zone of the formation subjected to a fracturing operation chosen from a so-called characteristic set, formed of the following characteristic magnitudes, knowing at least one of these characteristic magnitudes, the stress intensity factor of the formation, the minimum in situ principle stress and the fracture height designated respectively by $K_{1C}$, $\sigma_3$ and $H_F$, the fracture height depending furthermore on operating conditions of the fracturing operation, wherein during said fracturing operation there is determined one at least of two magnitudes which are the minimum pressure $P_m$ reached substantially in said zone and the volume $V_m$ of fluid introduced into the fracture from the moment when the fracture begins up to the moment when said minimum pressure is reached and wherein there is determined said desired characteristic magnitude from at least one of the two following relationships:

$$\frac{H_F}{2} = \left( \frac{3V_m E}{8\sqrt{\pi}\,(1-\eta^2)K_{1C}} \right)^{\frac{2}{5}}$$

$$\sigma_3 = P_m - K_{1C}\left(\frac{\pi}{2H_F}\right)^{\frac{1}{2}}$$

in which $P_m$ is said minimum pressure, $V_m$ is said volume of fluid introduced into the fracture E and n being characteristics of the rock respectively Young's modulus and Poisson's coefficient, $K_{1C}$, $\sigma_3$ and $H_F$ being the three characteristic magnitudes of said characteristic set.

2. The method as claimed in claim 1, wherein the fracturing is accomplished by injecting a substantially incompressible fracturing fluid at a substantially constant volumetric flowrate and the lapse of time $t_m$ separating the moment when the fracture begins from the moment when said minimum pressure $P_m$ is reached is measured in order to determine the volume $V_m$ of the fracturing operation.

* * * * *